United States Patent [19]

Key

[11] Patent Number: 4,800,608

[45] Date of Patent: Jan. 31, 1989

[54] TOOTHBRUSH

[76] Inventor: John R. Key, 709 Scurry, Big Spring, Tex. 79720

[21] Appl. No.: 104,236

[22] Filed: Oct. 5, 1987

[51] Int. Cl.[4] ..... A46B 9/04

[52] U.S. Cl. ..... 15/167.1

[58] Field of Search ..... 15/167.1, 167.2, 106, 15/110, 160, 143 R

[56] References Cited

U.S. PATENT DOCUMENTS

| | | | |
|---|---|---|---|
| 1,369,664 | 2/1921 | Izawa | 15/167.1 |
| 1,639,880 | 8/1927 | Butler | 15/167.1 |

FOREIGN PATENT DOCUMENTS

| | | | |
|---|---|---|---|
| 826440 | 1/1952 | Fed. Rep. of Germany | 15/110 |
| 796216 | 1/1936 | France | 15/167.1 |

*Primary Examiner*—Peter Feldman

[57] ABSTRACT

An improved toothbrush design incorporating a bristle head including a fixed obtuse angle. This toothbrush is designed to be the sole implement needed for dental hygiene. The angled bristle head provides superior cleansing of the lingual, buccal, embrasure, and distal aspects of the teeth and gums.

3 Claims, 2 Drawing Sheets

(PRIOR APT)

TOOTHBRUSH

FIELD OF THE INVENTION

This invention relates to toothbrushes for use in maintaining general oral hygiene and, more specifically, to toothbrushes for use in areas of the teeth and gums difficult to reach with a standard toothbrush. Many areas of the teeth and gums are inaccessible to a person using a standard toothbrush, or at a minimum are very difficult to reach. Because of its straight bristle head the standard toothbrush (FIGS. 1 and 2) does not clean properly in the embrasure 18, buccal 19, and distal 17 areas. The result of these shortcomings of standard toothbrushes is an accumulation of plaque even in very hygienic patients. Plaque is calcified by ions in the saliva if not removed within twenty-four hours, and thereafter can be removed only by a dentist. Plaque and calculous are well known factors of tooth decay and periodontal disease. Although the incidence to tooth decay is decreasing, the increase in periodontal disease, now the leading cause of tooth loss in adults, clearly illustrates the failures of the standard toothbrush and demonstrates the need for an improved tool of oral prophylaxis.

The bristle head of the standard toothbrush is configured so that in use on the buccal and lingual aspects of the teeth (FIG. 1), the bristles do not reach the embrasure area, thereby allowing an accumulation of plaque. Similarly, when used in an attempt to clean the distal aspects of the most distal teeth, the straight bristle head of the standard toothbrush makes it very difficult, and in some cases impossible, to effectively remove plaque and other particle irritants. (FIG. 2)

The method of choice for removing plaque is to first move the toothbrush parallel to the gums to loosen plaque and other particles. The toothbrush is then moved along the length of the tooth to remove the particles. When used in this manner, a standard toothbrush must be manipulated precisely by a patient who takes an inordinate interest in dental hygiene, or the problem embrasure areas will not be cleaned. The improved toothbrush of this invention includes a bristled head bent at a fixed obtuse angle, which naturally encourages the user to follow the recommended toothbrushing technique. When moved parallel to the gum line, the toothbrush of this invention loosens particles and plaque in the same manner as a standard toothbrush. (FIG. 4) Because the head is fixed at an obtuse angle, when this improved toothbrush is used to clean lingual 20, buccal 19, or embrasure 18 areas, the bristles located at the distal and proximal ends of the angled bristle head reach into the embrasure area 18, and thereby loosen and remove plaque and particle irritants that are not reached by standard toothbrushes.

The recommended toothbrushing technique makes no provision for cleaning the most distal aspects of the most distal teeth, because a standard toothbrush with a straight bristle head in many cases cannot reach the gum line, and in other cases will reach only at the expense of the user experiencing pain or gagging. In contrast, the toothbrush of this invention, because of its obtuse angled bristle head, is easy to manuever and reaches the distal aspects 17 of the most distal teeth without causing pain or gagging. (FIG. 5).

DESCRIPTION OF THE PRIOR ART

The fixed obtuse angle of the bristle head of the toothbrush of this invention is an improvement over prior art toothbrushes because the angled bristle head provides superior cleansing of the embrasure, buccal, and lingual areas. No prior art toothbrush specifically addresses the problem of cleaning in the embrasure areas, and no prior art toothbrush provides the superior cleansing for the distal aspects of the most distal teeth without sacrificing performance in other areas.

Presently known patents which may be relevant are as follows:

The Burleigh toothbrush, U.S. Pat. No. 1,327,807, utilizes a pliable tapered angled head, in contrast to the toothbrush of this invention. In use the resilient brush head of the Burleigh toothbrush is designed to flex backward in a curve, separating the bristles, making the Burleigh toothbrush unsuitable for use in cleaning the hard to reach distal areas and difficult to use when cleaning the lingual, buccal, and embrasure areas.

The Makowsky toothbrush, U.S. Pat. No. 3,193,864, is typical of a class of toothbrushes, those toothbrushes with multiple brush heads. These toothbrushes are designed to brush several accessible surfaces of the teeth at once. One consequence of this design, however, is that these toothbrushes are not suitable for the recommended brushing technique on all surfaces, and in fact they must be used in combination with another toothbrush. In particular, the distal aspects of the posterior teeth are at best very difficult to reach by a person using one of this class of toothbrushes.

The so called "REACH" toothbrush includes a slightly smaller bristle head and a neck which is bent at an angle from the handle. This toothbrush is in essence misnamed, because it is not a significant improvement over prior art for the purpose of reaching the distal aspects of the most distal teeth, and it makes no special provision of cleaning the lingual, buccal, and embrasure areas.

The Beggs toothbrush, U.S. Pat. No. 4,502,177, is one piece of prior art that is suitable for cleansing the distal aspects of the most distal teeth, in fact it is specifically designed for only that task. The Beggs toothbrush is meant to be used in combination with a standard toothbrush, and only the use of more than one toothbrush will provide for complete dental hygiene. The small bristle area, high compounded curve of the brush handle, and the unusual angle of the bristle attachment to the brush head make the Beggs toothbrush a limited purpose tool, best suited only for cleaning the lingual aspect of the anterior teeth.

The obtuse angled bristle head of the toothbrush of this invention provides performance superior to that of the limited purpose Beggs toothbrush when used for cleaning the distal aspects of the most distal teeth, and provides performance superior to all other prior art toothbrushes when used for that purpose. In addition the obtuse angled bristle head of the toothbrush of this invention provides superior access to the lingual, buccal, and embrasure areas, a significant improvement over the Beggs, "REACH", Makowsky, Burleigh, and other prior art toothbrushes.

SUMMARY

The toothbrush of this invention includes a handle, which is attached to a neck, which is attached to a bristle head with an included angle. The handle to neck, and neck to handle connections are at angles selected to provide a toothbrush that is comfortable to hold and easy to manipulate. The angle included in the bristle head is selected to provide the optimum performance characteristics for cleansing all areas of the teeth and gums, and in particular for cleansing the most distal aspects of the posterior teeth, and the lingual and buccal embrasure areas.

DETAILED DESCRIPTION OF PREFERRED EMBODIMENTS

Figure 1:
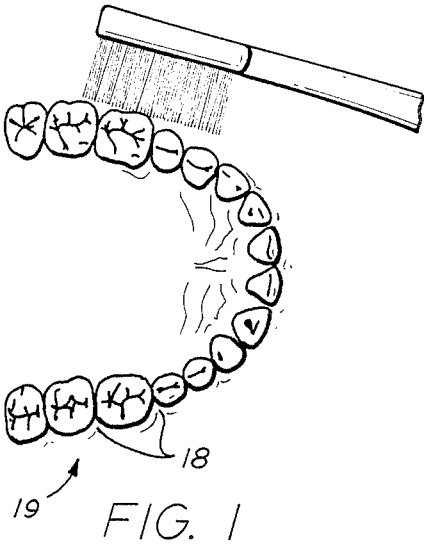
FIG. 1 is a plan view of a standard prior art toothbrush and an upper set of teeth.
Figure 2:
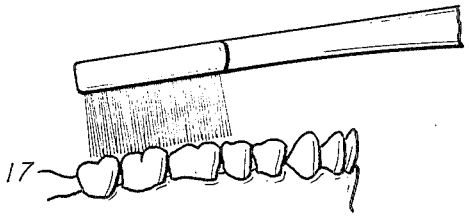
FIG. 2 (PRIOR ART)
FIG. 2 is an elevation of a standard prior art toothbrush and a lower set of teeth.

Referring to FIGS. 3 through 8, there are depicted embodiments of this invention illustrating the angled bristle head 10, neck 11, and handle 12. For ease of manufacture and economy the bristle head, neck, and handle may be formed in one piece in the usual manner, typically of plastic. The bristles themselves are typically nylon, and as depicted (FIGS. 3, 7 & 8) are of equal length, and are perpendicular to the angled bristle head 10 where attached 13 14. The angled bristle head 10 includes a distal segment 13 and a second segment 14 intermediate to the distal segment 13 and the neck 11. The distal segment 13 is fixed to the intermediate segment 14 at an obtuse angle 15 relative to the intermediate segment 14. The reasons for this obtuse angle 15 will be discussed in detail below. The longitudinal axes of the intermediate segment of the bristle head 14, the neck 11, and the handle 12 may be co-linear as in FIG. 3, or the axes of the intermediate segment of the bristle head 14 and the neck 11 may be co-linear, but with the neck 11 and handle 12 connection incorporating an obtuse angle 16 as in FIGS. 7 and 8. The neck and handle will also be discussed further below.

Figure 4:
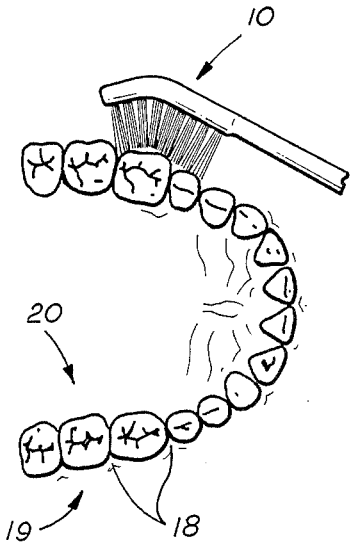
FIG. 4 is a plan view of one embodiment of this invention illustrating the cleansing action of the angled bristle head 10 in the buccal 19 and embrasure 18 areas of a lower set of teeth.
Figure 5:
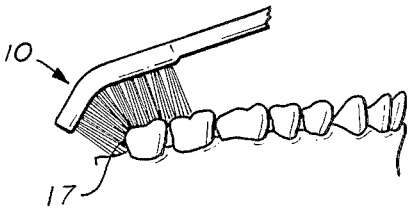
FIG. 5 is an elevation illustrating the cleansing action of the angled bristle head 10 in the distal area 1 of the most posterior teeth of lower set of teeth.
Figure 6:
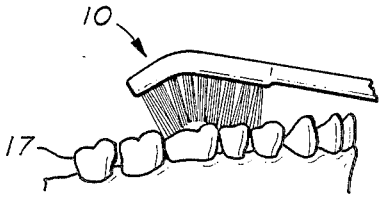
FIG. 6 is an elevation illustrating the cleansing action of one embodiment of this invention on the occlusal surfaces of a lower set of teeth.
Figure 8:
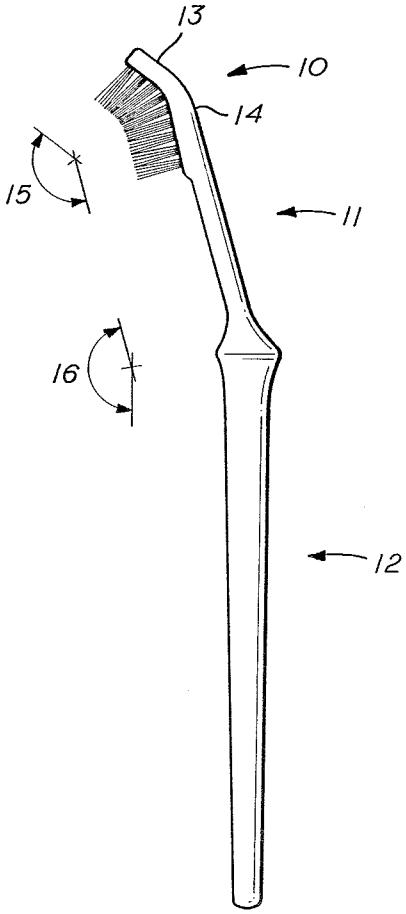
FIG. 8 is an elevation of an alternative embodiment of this invention illustrating the angled bristle head and a similarly angled handle.
Figure 7:
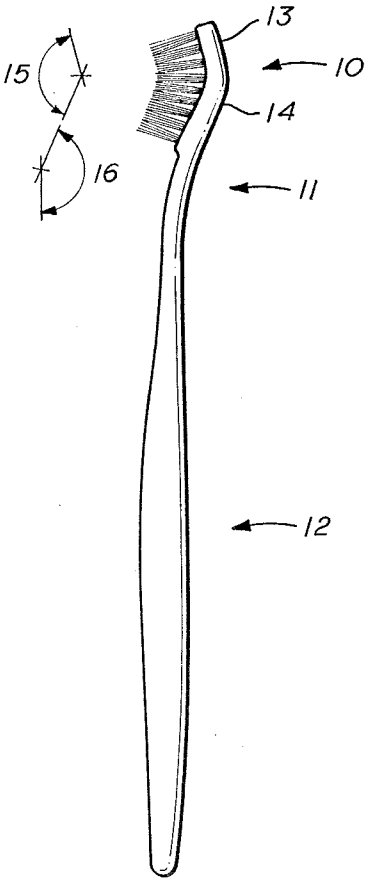
FIG. 7 is an elevation of an alternative embodiment of this invention illustrating the angled bristle head and a reverse angled handle.
Figure 3:
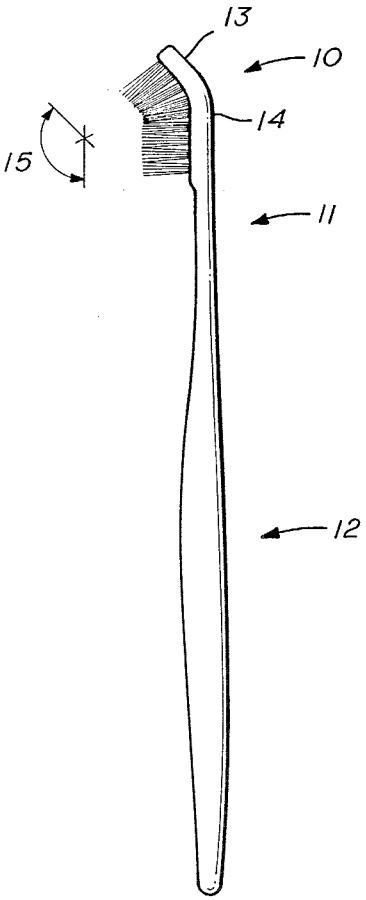
FIG. 3 is an elevation of one embodiment of the toothbrush of this invention, illustrating the angled bristle head 10.

The bristle head is designed including the obtuse angle 15 to provide for improved access to the distal aspects 17 of the posterior, or most distal teeth FIG. 5. Because these areas are accessible to a person using this improved toothbrush design there will be an increase in cleansing quality and a consequent improvement in overall dental hygiene. An obtuse angle 15 is used because a greater angle would not improve access to the distal aspects 17 of the most distal teeth, and a lesser angle would interfere with the operation of the toothbrush when used for cleansing the occlusal surfaces. FIG. 6. For ease of manufacture and ease of operation by the majority of users, an angle of approximately 135° provides improved access to the distal aspects 17 of the posterior teeth (see FIG. 5) and does not interfere with the bristle action when the improved toothbrush is used for cleansing the occlusal surfaces of the teeth. The total length of the bristle head, that is the length of the distal segment 13 plus the length of the intermediate segment 14, approximates that of a standard prior art toothbrush. FIGS. 3, 7, and 8. The combination of the obtuse angled bristle head 10, with an angle of approximately 135°, and a total bristle head length of approximately that of the standard prior art toothbrush, provides a further advantage in that when the toothbrush is used for cleansing the lingual 20 or buccal 19 aspects of the teeth (see FIG. 4) the bristles at the proximal and distal ends of the bristle head naturally reach in to the embrasure areas 18 and thereby loosen and remove plaque and particle irritants, providing for superior cleansing as compared to all prior art toothbrushes. The combination of the obtuse angled bristle head 10, with the angle of approximately 135°, and a total bristle head length of approximately that of the standard prior art toothbrush, also encourages the user to adopt the recommended tooth brushing technique. The bristles located at the proximal and distal ends of the angled bristle head 10 naturally reach into the embrasure area 18, and the bristles located at the vertex of the angle of the angled bristle head approximate the buccal 19 or lingual 20 surface contour of the teeth when the toothbrush of this embodiment is used to clean, respectively the buccal and lingual aspects of the teeth and gums. Therefore, the most natural method of brushing the teeth is to move the head of the toothbrush along the length of each tooth, away from the gums. FIG. 4. This is also the recommended method for brushing teeth as previously discussed.

Referring to FIG. 7, there is depicted the primary embodiment of the invention. This embodiment, as previously described, comprises an obtuse angled bristled head 10, neck 11 and handle 12. As previously described, the neck, handle, and angled head may be formed in one piece by the usual process, typically of injection molded plastic. The embedded bristles themselves may be nylon, and are embedded in the bristle head in the usual manner. As depicted in FIG. 7, the bristles of this embodiment are of equal length, and are perpendicular to the angled bristle head 10 where attached 13, 14. The embodiment depicted in FIG. 7 includes an obtuse angle 16 between the neck 11 and handle 12 junction. That is, the neck 11 is fixed to the handle 12 at an obtuse angle 16 relative to the handle. As illustrated by FIG. 7, the obtuse angle 16 of the neck 11 to handle 12 connection faces the opposite direction from the direction faced by the angle 15 included in the angled bristle head 10. Users wi? i find this combination of an obtuse angled bristled head, with a neck and handle providing an obtuse angle in the opposite direction relative to the angle of the bristle head, comfortable to use, and the cleaning performance will be superior to standard toothbrushes.

The neck 11 of each embodiment illustrated is an extension of the intermediate segment 14 of the angled bristle head 10. FIGS. 3, 7 and 8. That is, the longitudinal axis of the intermediate segment is co-linear with the longitudinal axis of the neck. FIGS. 4, 5, and 7. All embodiments are designed so that the neck 11 is narrower in cross-section than the bristle head 10. This will minimize any discomfort to the user when the toothbrush is maneuvered so as to reach difficult areas, such as the distal aspects of the posterior teeth, and in consequence the corners of the mouth are stretched across the neck 11 of the toothbrush. FIGS. 3, 7 and 8. In addition all embodiments also provide a handle 12 thicker in cross-section relative to the neck 11. FIGS. 3, 7 and 8. The thicker cross-section of the handle 12 provides the user with a more comfortable grip when the toothbrush is manipulated by the handle which is grasped in the usual manner.

Referring to FIG. 3 there is depicted an alternative embodiment of the invention. This embodiment shares the neck and handle cross section features and the angled bristle head that were described in the primary embodiment but omits the angle 16 between the neck 11 and handle 12 junction. The handle 12 of this alternative embodiment is an extension of the neck 11, as the neck 11 is similarly and extension of the proximal segment 14 of the bristle head 10, and as a result, the longitudinal axes of the handle, neck, and proximal segment of the bristle head are all co-linear. All mouths and all hands are not alike, and some users will find this embodiment more comfortable and efficient to use.

Another alternative embodiment of the invention is depicted in FIG. 8. This embodiment is also comprises a handle 12, neck 11, and obtuse angle bristle head 10 and like the previously described embodiments may be formed in the usual manner of plastic with nylon bristles. In addition to the characteristics of angled bristle head, and neck and handle cross-sections, that this embodiment shares with the previously described embodiments (FIGS. 3 and 7), this embodiment depicted in FIG. 8 includes an obtuse angle 16 between the neck 11 and handle 12 connection That is the neck 11 is connected to the handle 12 at an obtuse angle 16 relative to the handle 12. In contrast to the primary embodiment (FIG. 7) the obtuse angle 16 of the neck 11 to handle 12 connection of this embodiment faces the same direction as the included obtuse angle 15 of the angled bristle head 10. Some users will find this combination of same facing angles more comfortable to hold and more efficient and comfortable to use.

While this invention has been described fully and completely with special emphasis on preferred embodiments, it should be understood that the invention may be practiced otherwise and still come within the scope of the invention. Numerous other embodiments of the invention will become readily apparent to those of ordinary skill in the art in light of the teachings of this specification.

What is claimed is:

1. A new and improved toothbrush providing optimum cleaning performance for buccal, lingual and distal surfaces of the teeth and gums and optimum cleaning performance for the embrasure areas of the mouth comprising in combination, a plurality of bristles of even length and in rows; an angled head for holding said bristles, a handle and a neck connecting said handle to said angled head; wherein, (a) said angled bristle head is of constant width and comprises a distal segment, and a second segment intermediate to said distal segment and said neck;

(b) said distal segment fixed to said intermediate segment of an obtuse angle within the range of 115° and 155° relative to said intermediate segment;

(c) said neck is of narrower width and smaller cross-section than said bristle head, and at one end is made contiguous with the proximate end of said intermediate segment of said angled bristle head, and at the other end is made contiguous with said handle which is of larger cross-section than said bristle head;

(d) said two segments of said bristle head are provided on the inside, facing surfaces of said segments with plane surfaces for the attachment of said bristles;

(e) said bristles are perpendicular relative to the plane surfaces where attached to the plane surfaces formed on the inside of said bristle head segments, so that all bristles attached to a given segment of said bristles head are parallel and so that bristles mounted to the distal segment of the angled bristle head are facing the bristles mounted to the intermediate segment of the angled bristle head and so that the bristle ends of the bristles attached to the distal segment forms a plane facing and intersecting the plane of bristle ends formed by the bristles attached to the intermediate segment; and, (f) said handle has a longitudinally straight axis and is connected to said neck at an obtuse angle within the range of 115° and 155° relative to said neck.

2. A toothbrush of claim 1 wherein the obtuse angle of the neck to handle connection faces the direction opposite to the direction faced by the angle included in the angled bristle head.

3. The toothbrush of claim 1 wherein the obtuse angle of the neck to handle connection and the angle included in the angle bristle head face the same direction.

* * * * *